US009008537B2

(12) United States Patent
Shimohora

(10) Patent No.: US 9,008,537 B2
(45) Date of Patent: Apr. 14, 2015

(54) IMAGE FORMING APPARATUS

(71) Applicant: KYOCERA Document Solutions Inc., Osaka (JP)

(72) Inventor: Yuya Shimohora, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/286,259

(22) Filed: May 23, 2014

(65) Prior Publication Data

US 2014/0348534 A1 Nov. 27, 2014

(30) Foreign Application Priority Data

May 27, 2013 (JP) ..... 2013-110696

(51) Int. Cl.
*G03G 21/00* (2006.01)
*G03G 21/20* (2006.01)

(52) U.S. Cl.
CPC ..... *G03G 21/206* (2013.01); *G03G 21/007* (2013.01); *G03G 2215/00607* (2013.01)

(58) Field of Classification Search
CPC ..... G03G 21/007; G03G 21/0058; G03G 2215/00607
See application file for complete search history.

(56) References Cited

U.S. PATENT DOCUMENTS

| | | | | |
|---|---|---|---|---|
| 5,740,498 | A * | 4/1998 | Tsuchiya | 399/98 |
| 7,496,317 | B2 * | 2/2009 | Igarashi et al. | 399/124 |
| 2013/0084096 | A1 * | 4/2013 | Hashimoto | 399/98 |

FOREIGN PATENT DOCUMENTS

JP 7-25503 A 1/1995

* cited by examiner

*Primary Examiner* — Gregory H Curran
(74) *Attorney, Agent, or Firm* — Stein IP, LLC

(57) ABSTRACT

An image forming apparatus includes a roller pair, a paper dust collecting member, a scraping member, and a paper dust receiver. The paper dust collecting member can be drawn out from the apparatus main body and is disposed along an axis direction of the roller pair so as to collect paper dust adhered to one roller of the roller pair. The scraping member scrapes off paper dust adhered to the paper dust collecting member when the paper dust collecting member is moved in a draw-out direction. The paper dust receiver is disposed below the scraping member so as to receive the paper dust scraped off by the scraping member.

9 Claims, 7 Drawing Sheets

IMAGE FORMING APPARATUS

CROSS-REFERENCE TO RELATED APPLICATIONS

This application is based upon and claims the benefit of priority from the corresponding Japanese Patent Application No. 2013-110696, filed May 27, 2013, the entire contents of which are hereby incorporated by reference.

BACKGROUND OF THE INVENTION

The present disclosure relates to an image forming apparatus such as a copier, a printer, a facsimile machine, a multifunction peripheral thereof, and the like, using an electrophotographic method. In particular, the present disclosure relates to an image forming apparatus including a roller pair for transporting a paper sheet and a paper dust collecting member for collecting paper dust adhered to the roller pair.

Conventionally, in an image forming apparatus using an electrophotographic process, it is common to use a process in which a developing device visualizes an electrostatic latent image formed on an image carrier such as a photoreceptor drum, the visualized image (toner image) is transferred onto a paper sheet, and then a fixing process is performed.

The paper sheet is transported by rollers in the paper sheet transport path. In this case, paper dust is generated by friction between the paper sheet and the rollers. In particular, a registration roller pair, which corrects a skew of the paper sheet and transports the paper sheet to an image forming portion in synchronization with image formation timing, is apt to generate paper dust because the registration roller pair is required to nip the paper sheet with strong force. In a state where paper dust is adhered to an outer circumference surface of the registration roller pair, a transporting force of the registration roller pair is decreased so that jamming of the paper sheet may occur, or the paper dust moves to the image forming portion so that image malfunction may occur.

Therefore, there is known an image forming apparatus including paper dust collecting member that contact with the outer circumference surface of the registration roller pair so as to collect paper dust on the outer circumference surface of the registration roller pair. In this image forming apparatus, when paper dust adhered to the paper dust collecting member drops in the apparatus, a malfunction as described above (jamming of the paper sheet or the image malfunction) may occur. Therefore, when a predetermined time elapses, for example, the paper dust collecting member is drawn out in an extending direction of the registration roller pair and is replaced with a new paper dust collecting member.

SUMMARY OF THE INVENTION

An image forming apparatus according to one aspect of the present disclosure includes a roller pair, a paper dust collecting member, a scraping member, and a paper dust receiver. The roller pair is disposed in the apparatus main body so as to nip and transport a sheet. The paper dust collecting member can be drawn out from the apparatus main body and is disposed to contact with one roller of the roller pair along the axis direction of the roller pair so as to collect paper dust adhered to the roller pair. The scraping member is disposed in the apparatus main body and contacts with the paper dust collecting member so as to scrape off paper dust adhered to the paper dust collecting member when the paper dust collecting member is drawn out from the apparatus main body along the axis direction. The paper dust receiver is disposed below the scraping member so as to receive paper dust scraped off by the scraping member.

Further objects and specific advantages of the present disclosure will become more apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Now, an embodiment of the present disclosure is described with reference to the drawings.

Figure 1:
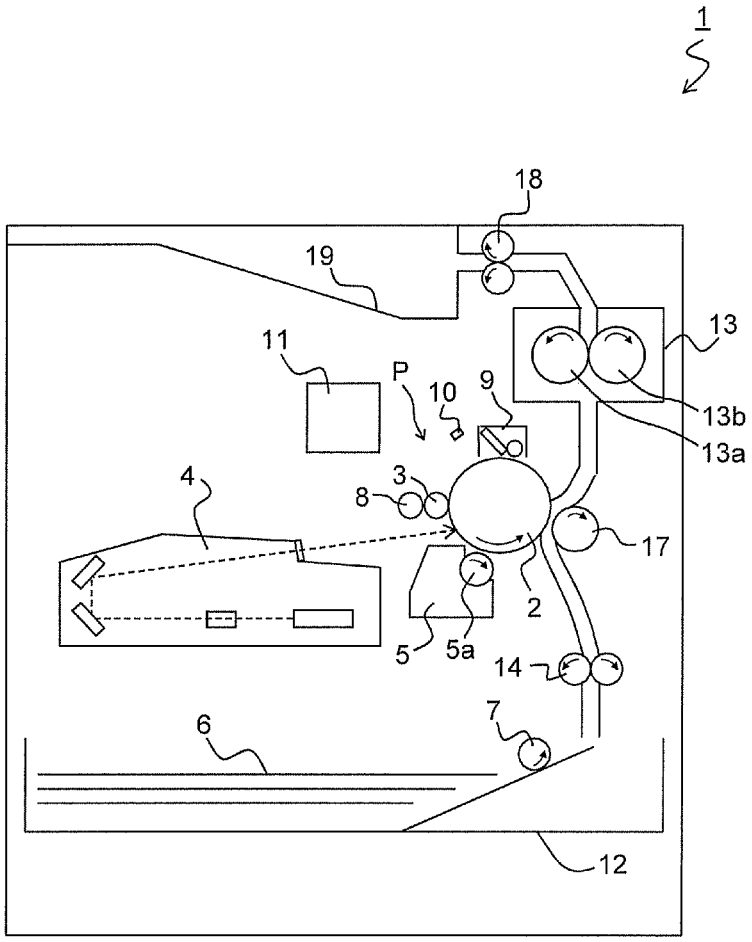
FIG. 1 is a cross-sectional view schematically illustrating a structure of an image forming apparatus according to one embodiment of the present disclosure.

With respect to FIGS. 1 to 8, an image forming apparatus 1 according to an embodiment of the present disclosure is described. Note that the left side in FIG. 1 corresponds to the front side of the image forming apparatus 1. As illustrated in FIG. 1, an image forming portion P is disposed in the image forming apparatus 1 (monochrome printer in this example). This image forming portion P forms a predetermined image by the steps of electrification, exposure, developing, and transferring.

A photoreceptor drum (image carrier) 2 for carrying a visualized image (toner image) is disposed in the image forming portion P. The toner image formed on the photoreceptor drum 2 is transferred onto a paper sheet 6, and is further fixed on the paper sheet 6 by a fixing unit 13. After that, the paper sheet 6 is discharged from the apparatus main body. The photoreceptor drum 2 is rotated by a drum drive motor (not shown) in a counterclockwise direction in FIG. 1 while an image forming process is performed on the photoreceptor drum 2.

Next, the image forming portion P is described in detail. Around and in front of the photoreceptor drum 2 disposed in a rotatable manner (in the left side of the photoreceptor drum 2 in FIG. 1), there are disposed a charging roller 3 for charging the photoreceptor drum 2, an exposure unit 4 for exposing image information on the photoreceptor drum 2, a developing unit 5 for forming the toner image on the photoreceptor drum 2, a cleaning device 9 for collecting developer (toner) remaining on the photoreceptor drum 2, and a charge eliminator 10 for eliminating the electrostatic latent image.

First, the surface of the photoreceptor drum 2 is uniformly charged by the charging roller 3, and then light irradiation is performed by the exposure unit 4 so as to form the electrostatic latent image corresponding to an image signal on the photoreceptor drum 2. The developing unit 5 includes a developing roller 5*a* disposed to be opposed to the photoreceptor drum 2. A predetermined amount of positively charged magnetic one-component toner is filled in the developing unit 5 from a toner container 11. This toner is supplied to the surface of the photoreceptor drum 2 by the developing roller 5*a* to which a developing bias is applied from a developing bias applying device (not shown), and is adhered to the photoreceptor drum 2 in an electrostatic manner. Thus, a toner image is formed corresponding to the electrostatic latent image formed by the exposure by the exposure unit 4.

The paper sheet 6 to which the toner image is to be transferred is stored in a sheet feed cassette 12 for storing the paper sheets 6. The paper sheet 6 is transported by a sheet feed roller 7 and a registration roller pair 14 to the photoreceptor drum 2 on which the toner image is formed. On this occasion, an image write signal is turned on, and the image formation is performed on the photoreceptor drum 2 so that the toner image is transferred on a predetermined position of the paper sheet 6. Further, below the photoreceptor drum 2, a transferring roller 17 applied with a predetermined transferring bias applies an electric field so that the toner image on the photoreceptor drum 2 is transferred onto the paper sheet 6. Note that the transferring roller 17 is applied with a negative transferring bias that is opposite to a polarity of the toner when an image is formed (in print operation).

The paper sheet 6 with the transferred toner image is transported to the fixing unit 13. In addition, the photoreceptor drum 2 after transferring the toner image is prepared for a next formation of a new electrostatic latent image so that toner remaining on the surface of the photoreceptor drum 2 is collected by the cleaning device 9. The paper sheet 6 transported to the fixing unit 13 is heated and pressed by a fixing roller 13*a* and a pressing roller 13*b* so that the toner image is fixed onto a surface of the paper sheet 6 to form a predetermined image. The paper sheet 6 with the formed image is then discharged onto a discharge tray 19 by a discharge roller pair 18.

In front of the photoreceptor drum 2, there is disposed the charging roller 3 contacting with the drum surface in a rotatable manner so as to charge the drum surface. In front of the charging roller 3, there is a cleaning brush 8 contacting with the surface of the charging roller 3 so as to clean the roller surface.

The photoreceptor drum 2 is connected to the above-mentioned drum drive motor via a drive gear (not shown) so as to rotate in the counterclockwise direction as described above in the diagram.

The charging roller 3 is supported by the apparatus main body in a rotatable manner. In addition, the charging roller 3 is pressed to the photoreceptor drum 2 by a predetermined nip pressure and rotates to follow the photoreceptor drum 2. In addition, when an image is formed (in the print operation), the charging roller 3 is applied with a charging bias having the same polarity as the toner (positive polarity in this example).

Next, a peripheral structure of the registration roller pair 14 is described in detail.

The registration roller pair 14 is constituted of a metal roller as a drive roller made of iron for example and a rubber roller as a following roller. The two rollers are disposed in parallel and are pressed to each other so as to form a nip portion. The registration roller pair 14 corrects a skew of the paper sheet 6 when a front end of the paper sheet 6 abuts the nip portion. In addition, the registration roller pair 14 is driven to rotate by a drive motor (not shown) so as to transport the paper sheet 6 to the image forming portion P in synchronization with image formation timing.

Figure 2:
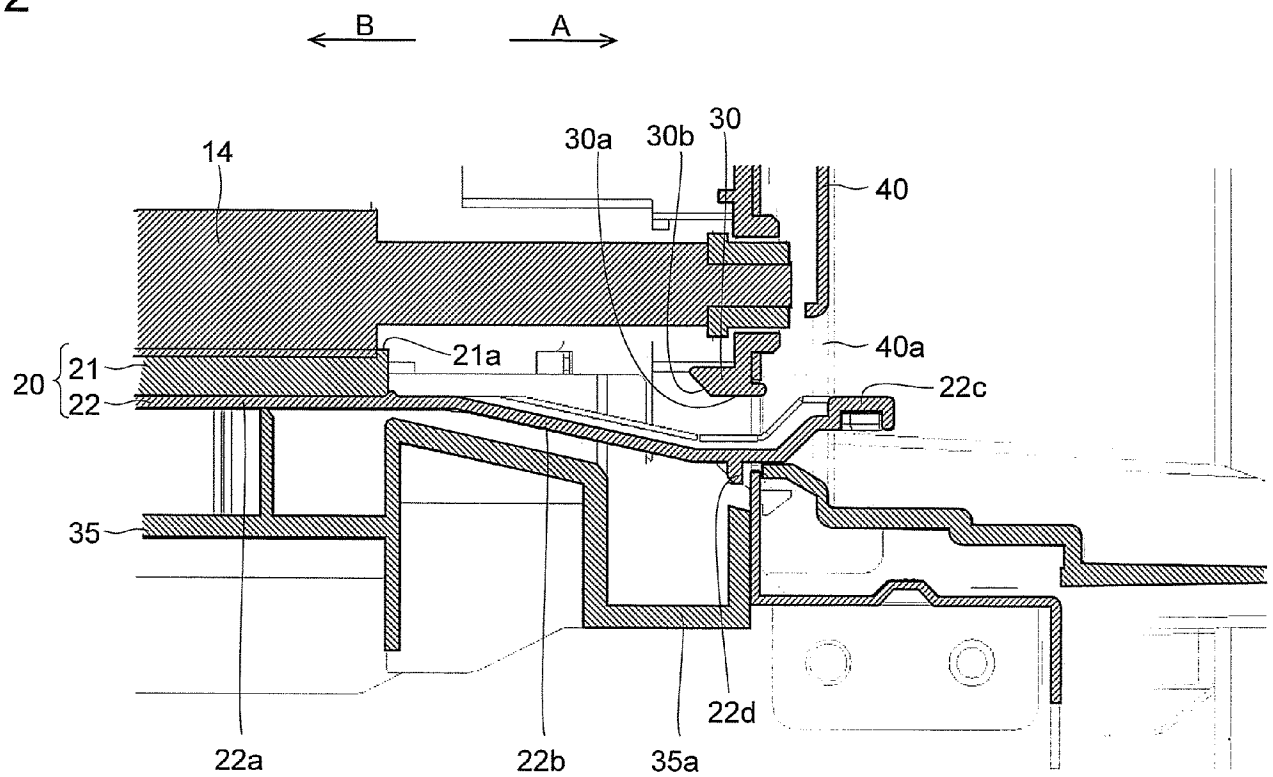
FIG. 2 is a cross-sectional view illustrating a peripheral structure of a scraping member and a paper dust receiving recess of the image forming apparatus according to the one embodiment of the present disclosure.
Figure 3:
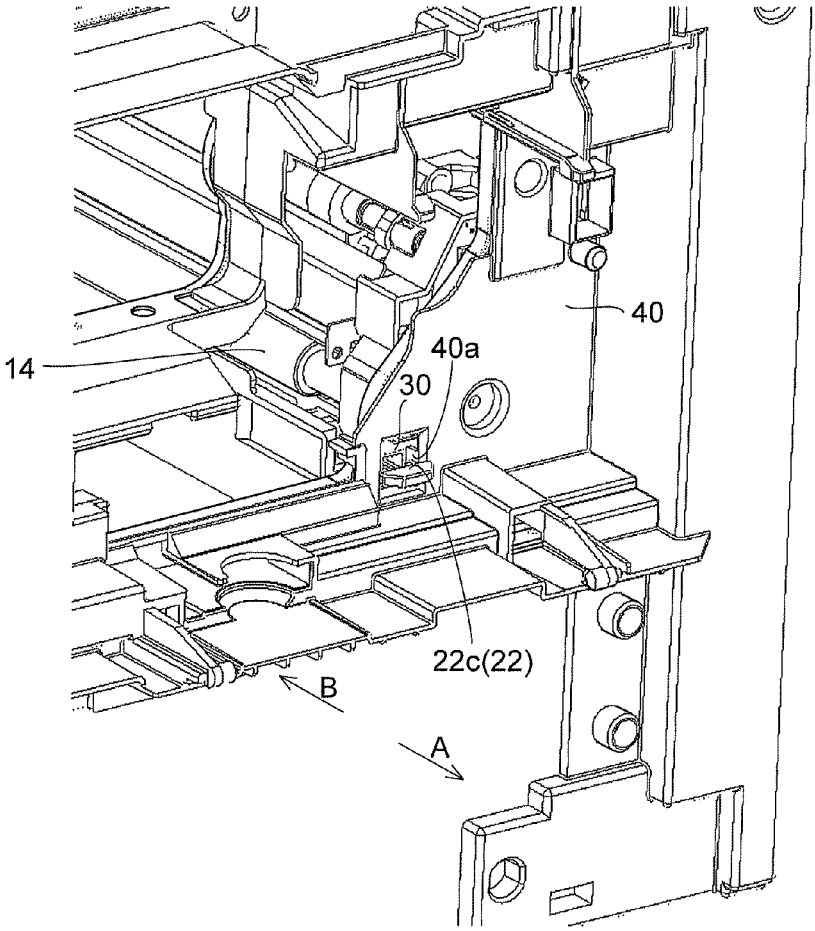
FIG. 3 is a perspective view illustrating a peripheral structure of a registration roller pair in an A-direction side of the image forming apparatus according to the one embodiment of the present disclosure.

As illustrated in FIG. 2 and FIG. 3, a paper dust collecting member 20 is disposed in a vicinity of the registration roller pair 14. The paper dust collecting member 20 extends in an A-direction (draw-out direction) along the registration roller pair 14 and is movable in a reciprocating manner on a rail (not shown) along the A-direction (axis direction of the registration roller pair 14). In addition, the paper dust collecting member 20 is configured to contact with the outer circumference surface of one roller of the registration roller pair 14 as illustrated in FIG. 2 and FIG. 4, so as to collect paper dust adhered to the registration roller pair 14.

Figure 4:
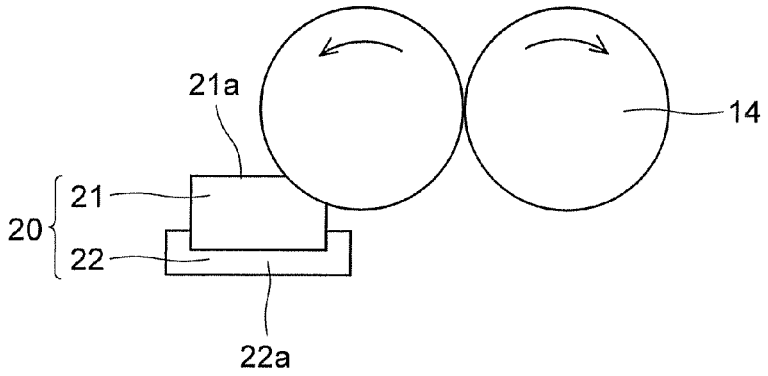
FIG. 4 is a cross-sectional view illustrating the registration roller pair and the paper dust collecting member of the image forming apparatus viewed from the A-direction side according to the one embodiment of the present disclosure.

The paper dust collecting member 20 includes an elastic member (contact member) 21 made of sponge contacting with one roller of the registration roller pair 14 (the metal roller for example, which is the left side roller in FIG. 4) so as to collect paper dust, and a support member 22 made of resin for supporting the elastic member 21. The elastic member 21 is formed in a rectangular solid shape elongated in the A-direction and is fixed to the support member 22 with adhesive. In addition, an upper face 21*a* of the elastic member 21 is a collecting face for contacting with the one roller of the registration roller pair 14 so as to collect paper dust.

As illustrated in FIG. 2, the support member 22 includes a supporting portion 22*a* for supporting the elastic member 21, a gripper (operation portion) 22*c* disposed in the A-direction of the supporting portion 22*a* for an operator to grip, and a connecting portion 22*b* for connecting between the supporting portion 22*a* and the gripper 22*c*. The supporting portion 22*a* is formed to extend horizontally in parallel to the registration roller pair 14. The connecting portion 22*b* is inclined downward from the supporting portion 22*a* so as to be located lower than the supporting portion 22*a*. In addition, the connecting portion 22*b* is disposed below a scraping member 30 when the paper dust collecting member 20 is mounted in the apparatus main body. The gripper 22*c* is disposed outside (the A-direction side) of an opening 40*a* in a side wall member 40 that will be described later when the paper dust collecting member 20 is mounted in the apparatus main body. In addition, in the lowest part of the connecting portion 22*b*, there is a stopper 22*d* protruding downward so as to abut the side wall member 40 that will be described later of the apparatus main body when the paper dust collecting member 20 moves in the A-direction (draw-out direction) from the mounted state in the apparatus main body. In this way, the paper dust collecting member 20 is prevented from moving out from the opening 40*a* that will be described later.

On the A-direction side of the paper dust collecting member 20, there is disposed the side wall member 40. In the side wall member 40, there is formed the opening 40*a* through which the paper dust collecting member 20 can pass in the A-direction. The scraping member 30 is disposed in a B-direction (opposite to the A-direction) of the opening 40*a*, namely inside the opening 40*a*.

Figure 5:
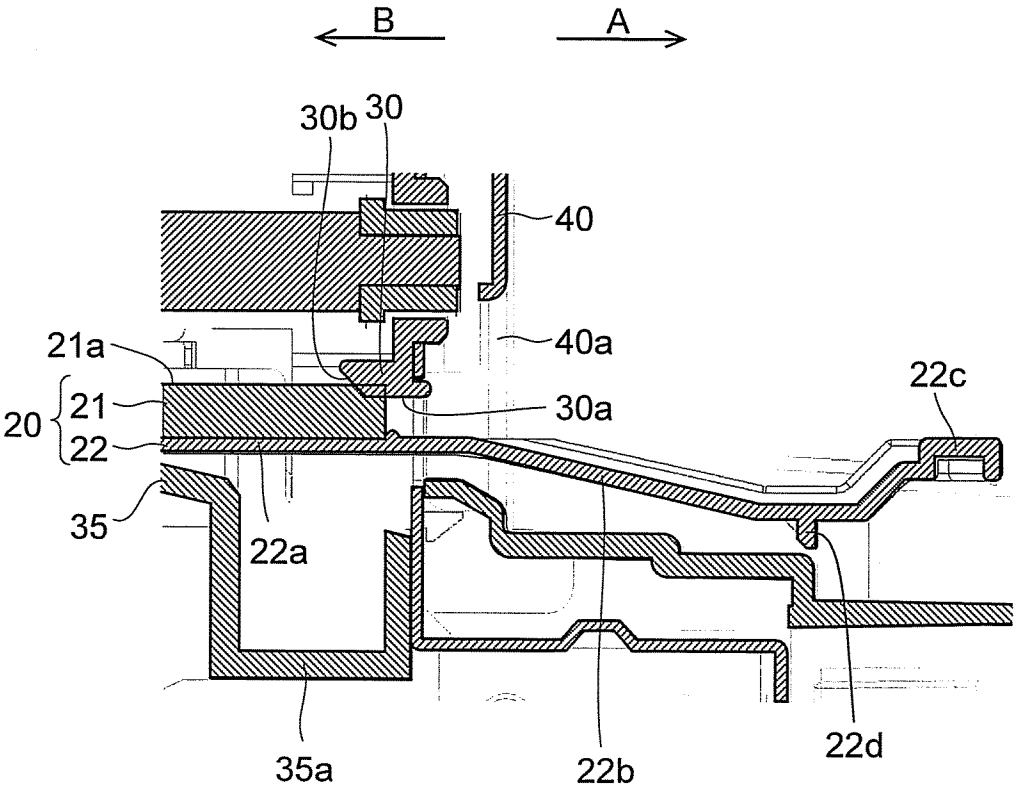
FIG. 5 is a cross-sectional view illustrating a state on the way of drawing out the paper dust collecting member in the A-direction in the image forming apparatus according to the one embodiment of the present disclosure.
Figure 6:
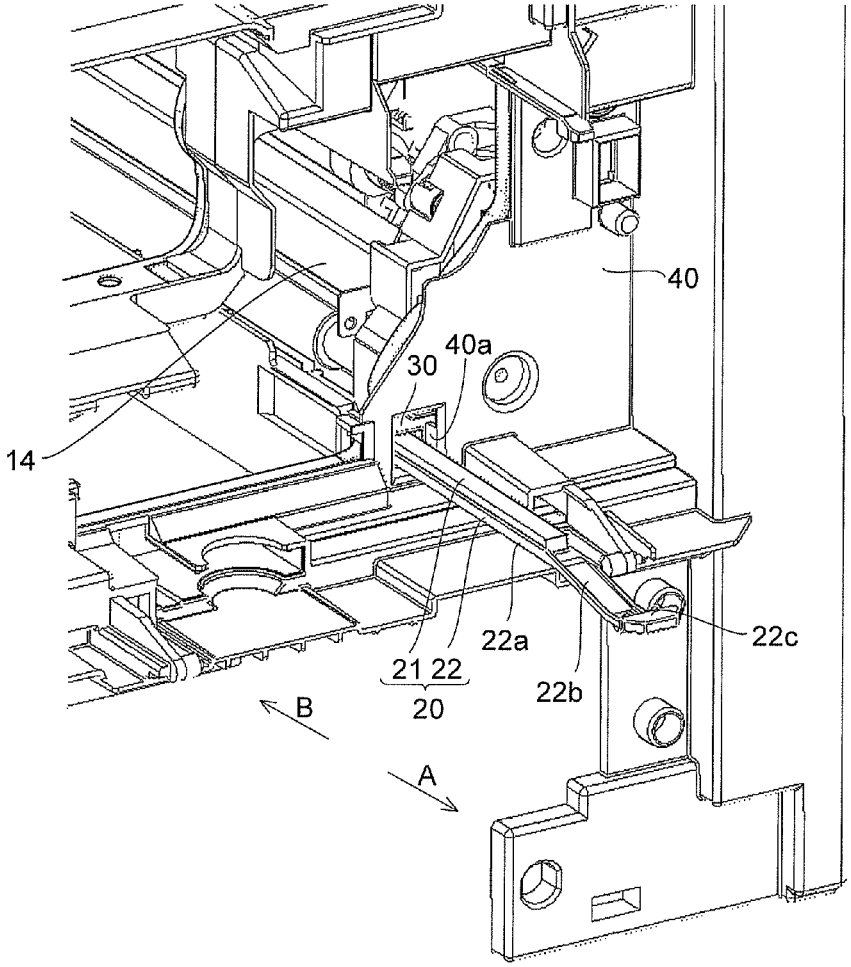
FIG. 6 is a perspective view illustrating a state on the way of drawing out the paper dust collecting member in the A-direction in the image forming apparatus according to the one embodiment of the present disclosure.

As illustrated in FIG. 5 and FIG. 6, the scraping member 30 scrapes paper dust adhered to the paper dust collecting member 20 when the paper dust collecting member 20 moves in the A-direction (is drawn out). As illustrated in FIG. 2, a bottom face 30*a* of the scraping member 30 is disposed lower than a contact position between the one roller of the registration roller pair 14 and the upper face 21*a* of the elastic member 21. Therefore, when the paper dust collecting member 20 is drawn out in the A-direction, the scraping member 30 contacts with the elastic member 21 as illustrated in FIG. 5. A side face 30*b* in the B-direction (inside face) of the scraping member 30 has a function of scraping off the paper dust adhered to the elastic member 21 and is inclined downward to the A-direction. The scraping member 30 has a width (a length in the direction perpendicular to the paper plane of FIG. 5) larger than the elastic member 21.

Figure 7:
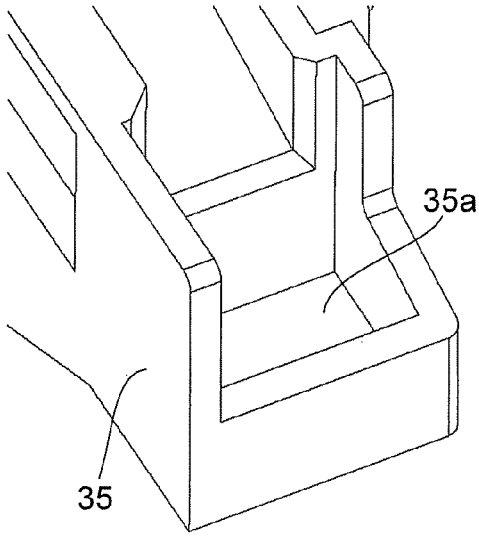
FIG. 7 is a perspective view illustrating a structure of a paper dust receiving recess of the image forming apparatus according to the one embodiment of the present disclosure.
Figure 8:
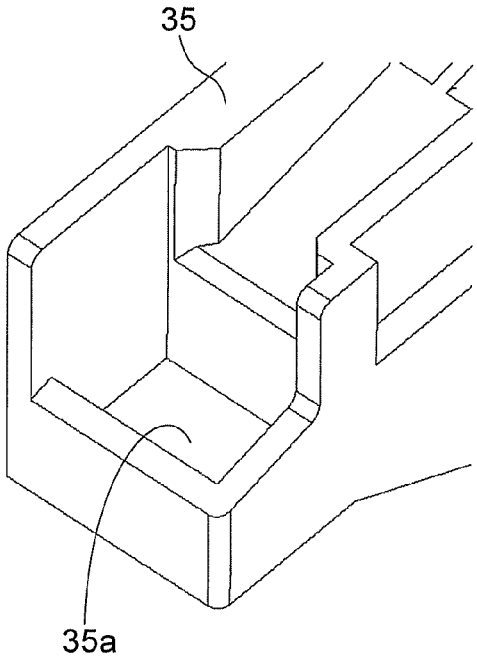
FIG. 8 is a perspective view illustrating a structure of the paper dust receiving recess of the image forming apparatus according to the one embodiment of the present disclosure.

Below the scraping member 30, there is disposed a paper dust receiving recess (paper dust receiver) 35*a* for receiving paper dust scraped off by the scraping member 30. As illustrated in FIG. 7 and FIG. 8, the paper dust receiving recess 35*a* is formed integrally with a member 35 made of resin of the apparatus main body. Therefore, it is not necessary to dispose an additional member to form the paper dust receiving recess 35*a*.

In this image forming apparatus 1, the paper dust collecting member 20 is in the state illustrated in FIG. 2 and FIG. 3 in the normal state. On the other hand, when maintenance is performed, the paper dust collecting member 20 is drawn out by an operator in the A-direction as illustrated in FIG. 5 and FIG. 6. In this case, paper dust adhered to the elastic member 21 is scraped off by the scraping member 30 and is stored in the paper dust receiving recess 35*a*. Note that the paper dust receiving recess 35*a* has a sufficient capacity for receiving paper dust, and the paper dust stored in the paper dust receiving recess 35*a* is discarded by the operator when the image forming apparatus 1 is inspected periodically. Therefore, the user is not required to discard the paper dust stored in the paper dust receiving recess 35*a*.

When the paper dust collecting member 20 is sufficiently drawn out, paper dust is scraped off from one end in the A-direction to the other end in the B-direction of the elastic member 21. Then, the paper dust collecting member 20 is inserted again in the B-direction by the operator so as to return to the state illustrated in FIG. 2 and FIG. 3.

In this embodiment, as described above, the scraping member 30 scrapes off paper dust adhered to the paper dust collecting member 20 when the paper dust collecting member 20 moves in the A-direction, and the paper dust receiving recess 35*a* disposed below the scraping member 30 receives the paper dust scraped off by the scraping member 30. In this way, when the paper dust collecting member 20 is drawn out (moves) in the A-direction, paper dust adhered to the paper dust collecting member 20 can be scraped off by the scraping member 30. Then, the paper dust scraped by the scraping member 30 can be stored in the paper dust receiving recess 35*a*. Therefore, it is possible to prevent paper dust from scattering in the apparatus. Thus, it is possible to suppress occurrence of jamming of the paper sheet due to adhesion of paper dust to the outer circumference surface of the registration roller pair 14 and occurrence of image malfunction due to movement of paper dust to the image forming portion P.

In addition, because paper dust adhered to the paper dust collecting member 20 is scraped off, the paper dust collecting member 20 can be used repeatedly. Thus, it is not necessary to replace the paper dust collecting member 20 with a new one, and hence increase of cost can be suppressed. In addition, without exchanging the paper dust collecting member 20, it is sufficient to draw out and insert (moves along the A-direction) the paper dust collecting member 20, and hence maintainability can be improved.

In addition, as described above, even in the case where the side wall member 40 having the opening 40*a* through which the paper dust collecting member 20 passes is disposed on the A-direction side of the paper dust collecting member 20, the scraping member 30 is disposed inside (in the B-direction) of the opening 40*a*. Therefore, when the paper dust collecting member 20 is drawn out (moves) in the A-direction, it is possible to prevent paper dust from scattering in the apparatus due to contact between the paper dust collecting member 20 and the opening 40*a*.

In addition, as described above, the side face 30*b* of the scraping member 30 in the B-direction is inclined downward to the A-direction. Thus, the scraped off paper dust can easily drop from the side face 30*b* of the scraping member 30, and the paper dust can be easily stored in the paper dust receiving recess 35*a*. In addition, comparing with the case where the side face 30*b* of the scraping member 30 is vertical, the paper dust collecting member 20 can be drawn out (move) in the A-direction with smaller load.

In addition, as described above, the upper face 21*a* of the paper dust collecting member 20 is the collecting face contacting with one roller of the registration roller pair 14 so as to collect paper dust, and the bottom face 30*a* of the scraping member 30 is disposed lower than the contact position between one roller of the registration roller pair 14 and the upper face (collecting face) 21*a* of the paper dust collecting member 20. Thus, when the paper dust collecting member 20 is drawn out (move) in the A-direction, the scraping member 30 can easily contact with the paper dust collecting member 20. Therefore, the scraping member 30 can easily scrape off paper dust adhered to the paper dust collecting member 20.

In addition, as described above, the connecting portion 22*b* of the support member 22 is disposed lower than the supporting portion 22*a*. In this way, it is possible to prevent the connecting portion 22*b* from contacting with the scraping member 30. Therefore, it is possible to prevent the surface (the bottom face 30*a* and the side face 30*b*) of the scraping member 30 from being damaged. Thus, it is possible to prevent a decrease of paper dust scraping performance of the scraping member 30.

In addition, because the registration roller pair 14 is apt to generate paper dust in particular, it is particularly effective that the paper dust collecting member 20, the scraping member 30 and the paper dust receiving recess 35*a* of the present disclosure are disposed in a vicinity of the registration roller pair 14 as described above.

Note that the embodiment disclosed above is an example in all respects and should not be interpreted as a limitation. The scope of the present disclosure is defined not by the above description of the embodiment but by the claims and further includes all modification within meanings and scope equivalent to the claims.

For instance, there is described above the case where the present disclosure is applied to a monochrome printer, but the present disclosure is not limited to this case. It is needless to say that the present disclosure can be applied to various image forming apparatuses such as a color printer, a monochrome copier, a digital multifunction peripheral, a facsimile machine, and the like, including the roller pair for transporting a paper sheet, the paper dust collecting member for collect paper dust adhered to the roller pair.

In addition, in the embodiment described above, there is described the example in which paper dust adhered to the registration roller pair is collect, but the present disclosure is not limited to this example. It is possible to configure to collect paper dust adhered to a roller pair other than the registration roller pair.

In addition, in the embodiment described above, there is described the example in which the inner side face of the scraping member is formed to be inclined downward to the draw-out direction, but the present disclosure is not limited to this example. It is possible to form the inner side face of the scraping member to be vertical or to form the inner side face of the scraping member to be inclined upward to the draw-out direction.

What is claimed is:

1. An image forming apparatus comprising:

a roller pair disposed in an apparatus main body so as to nip and transport a sheet;

a paper dust collecting member capable of being drawn out from the apparatus main body, disposed to contact with one roller of the roller pair along an axis direction of the roller pair so as to collect paper dust adhered to the roller pair;

a scraping member disposed in the apparatus main body so as to contact with the paper dust collecting member and to scrape off paper dust adhered to the paper dust collecting member when the paper dust collecting member is moved along the axis direction in a draw-out direction from the apparatus main body; and a paper dust receiver disposed below the scraping member so as to receive paper dust scraped off by the scraping member.

2. The image forming apparatus according to claim 1, wherein the apparatus main body includes a side wall member having an opening through which the paper dust collecting member can pass in the draw-out direction, and the scraping member is disposed inside the opening.

3. The image forming apparatus according to claim 1, wherein the scraping member has an inner side face inclined downward to the draw-out direction and a bottom face extending horizontally from the inner side face along the draw-out direction, and the bottom face contacts with the paper dust collecting member when the paper dust collecting member is drawn out.

4. The image forming apparatus according to claim 3, wherein an upper face of the paper dust collecting member is a collecting face contacting with one roller of the roller pair so as to collect the paper dust, and the bottom face of the scraping member is disposed lower than a contact position between the roller and the collecting face.

5. The image forming apparatus according to claim 2, wherein the paper dust collecting member includes a contact member contacting with the roller pair so as to collect the paper dust, and a support member supporting the contact member, the support member includes a supporting portion extending in the axis direction so as to support the contact member, an operation portion disposed on an end of the supporting portion in the draw-out direction, and a connecting portion for connecting between the supporting portion and the operation portion, and the operation portion is disposed outside the opening while the connecting portion is disposed below the scraping member in a state where the paper dust collecting member is mounted in the apparatus main body.

6. The image forming apparatus according to claim 5, wherein the connecting portion is provided with a stopper protruding downward so as to abut the side wall member of the apparatus main body when the paper dust collecting member moves in the draw-out direction from a state of being mounted in the apparatus main body.

7. The image forming apparatus according to claim 5, wherein the scraping member has a width larger than the contact member in a direction crossing the axis direction.

8. The image forming apparatus according to claim 1, wherein the paper dust receiver is formed integrally with the apparatus main body.

9. The image forming apparatus according to claim 1, wherein the roller pair is a registration roller pair configured to correct a skew of the sheet and to transport the sheet to an image forming portion in synchronization with image formation timing.

* * * * *